US007399939B2

(12) United States Patent
Hettinger et al.

(10) Patent No.: US 7,399,939 B2
(45) Date of Patent: Jul. 15, 2008

(54) APPLIANCE KNOB MOUNTING SYSTEM AND METHOD

(75) Inventors: Steve E. Hettinger, Louisville, KY (US); Mark A. Zaccone, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/586,961

(22) Filed: Oct. 26, 2006

(65) Prior Publication Data

US 2007/0095638 A1 May 3, 2007

Related U.S. Application Data

(63) Continuation-in-part of application No. 11/263,559, filed on Oct. 31, 2005, now abandoned.

(51) Int. Cl.
*H01H 19/00* (2006.01)

(52) U.S. Cl. ..... 200/336; 200/296

(58) Field of Classification Search ..... 200/11 R, 200/564–567, 296, 336, 302.1; 341/20, 35; 345/156, 184
See application file for complete search history.

(56) References Cited

U.S. PATENT DOCUMENTS 4,293,987 A 10/1981 Gottbreht et al.
4,304,976 A 12/1981 Gottbreht et al.
5,166,482 A 11/1992 Li
5,384,442 A 1/1995 Danner
6,153,837 A 11/2000 Garcia et al.
6,281,453 B1 * 8/2001 Uleski ..... 200/4
6,288,349 B1 9/2001 Motyka et al.
6,750,407 B2 6/2004 Song et al.
6,894,242 B2 * 5/2005 Muller et al. ..... 200/568
6,927,348 B1 * 8/2005 Schmidt et al. ..... 200/5 R
7,171,727 B2 2/2007 Wylie et al.
7,180,023 B2 * 2/2007 Seo ..... 200/329
7,192,102 B2 3/2007 Park et al.

* cited by examiner

*Primary Examiner*—Michael A Friedhofer
(74) *Attorney, Agent, or Firm*—George L. Rideout, Esq.; Armstrong Teasdale LLP

(57) ABSTRACT

A control panel assembly for controlling a home appliance is provided. The control panel assembly includes a control board including at least one functional component. A control panel is coupled to the control board. The control panel forms a central cylinder defining an opening. A knob is positioned within the opening. The knob includes a front side, a rear side, a first cylindrical portion extending from the rear side and coupled to the control panel, and a second cylindrical portion extending from the rear side. The knob is configured to shield the control board from damage.

19 Claims, 3 Drawing Sheets

APPLIANCE KNOB MOUNTING SYSTEM AND METHOD

CROSS REFERENCE TO RELATED APPLICATIONS

This is a continuation-in-part application of application Ser. No. 11/263,559, filed Oct. 31, 2005 now abandoned, which is hereby incorporated by reference in its entirety.

BACKGROUND OF THE INVENTION

This invention relates generally to home appliances and, more particularly, to an appliance knob mounting system and method.

Known home appliances include a control panel on which a plurality of control knobs is mounted. In some applications using an electronic control, a control chassis assembly is used to provide protection from imparted forces on the knob and prevent or limit control board contamination. Without the use of a chassis, the control board and its components are susceptible to damage from forces imparted to the knobs. As is the case with many home appliances, liquids may spill on the control board during use, which may contaminate the control board.

BRIEF DESCRIPTION OF THE INVENTION

In one aspect, a control panel assembly is provided for controlling a home appliance. The control panel assembly includes a control board including at. least one functional component. A control panel is coupled to the control board. The control panel forms a central cylinder defining an opening. A knob is positioned within the opening. The knob includes a front side, a rear side, a first cylindrical portion extending from the rear side and coupled to the control panel, and a second cylindrical portion extending from the rear side. The knob is configured to limit movement of the knob with respect to the control board.

In another aspect, a home appliance is provided. The home appliance includes a housing. A driving unit is received in the housing. The driving unit is configured to provide physical action within the home appliance. A control unit assembly controls the driving unit. The control unit assembly includes a control board including at least one functional component. A control panel is coupled to the control board. The control panel forms a central cylinder defining an opening. A knob is positioned within the opening. The knob includes a front side, a rear side, a first cylindrical portion extending from the rear side and coupled to the control panel, and a second cylindrical portion extending from the rear side. The knob is configured to limit movement of the knob with respect to the control board.

In still another aspect, a method is provided for assembling a control unit utilized in a home appliance for controlling operations thereof. The method includes providing a control board with at least one functional component. A rotary shaft is coupled to the control board. A control panel is coupled to the control board. The rotary shaft extends at least partially into an opening defined in the control panel. A knob is positioned within the opening. The knob has a front side, a rear side, a first cylindrical portion extending from the rear side and a second cylindrical portion extending from the rear side. The knob is coupled to the control panel. The knob is configured to limit movement of the knob with respect to the control board.

DETAILED DESCRIPTION OF THE INVENTION

Figure 1:
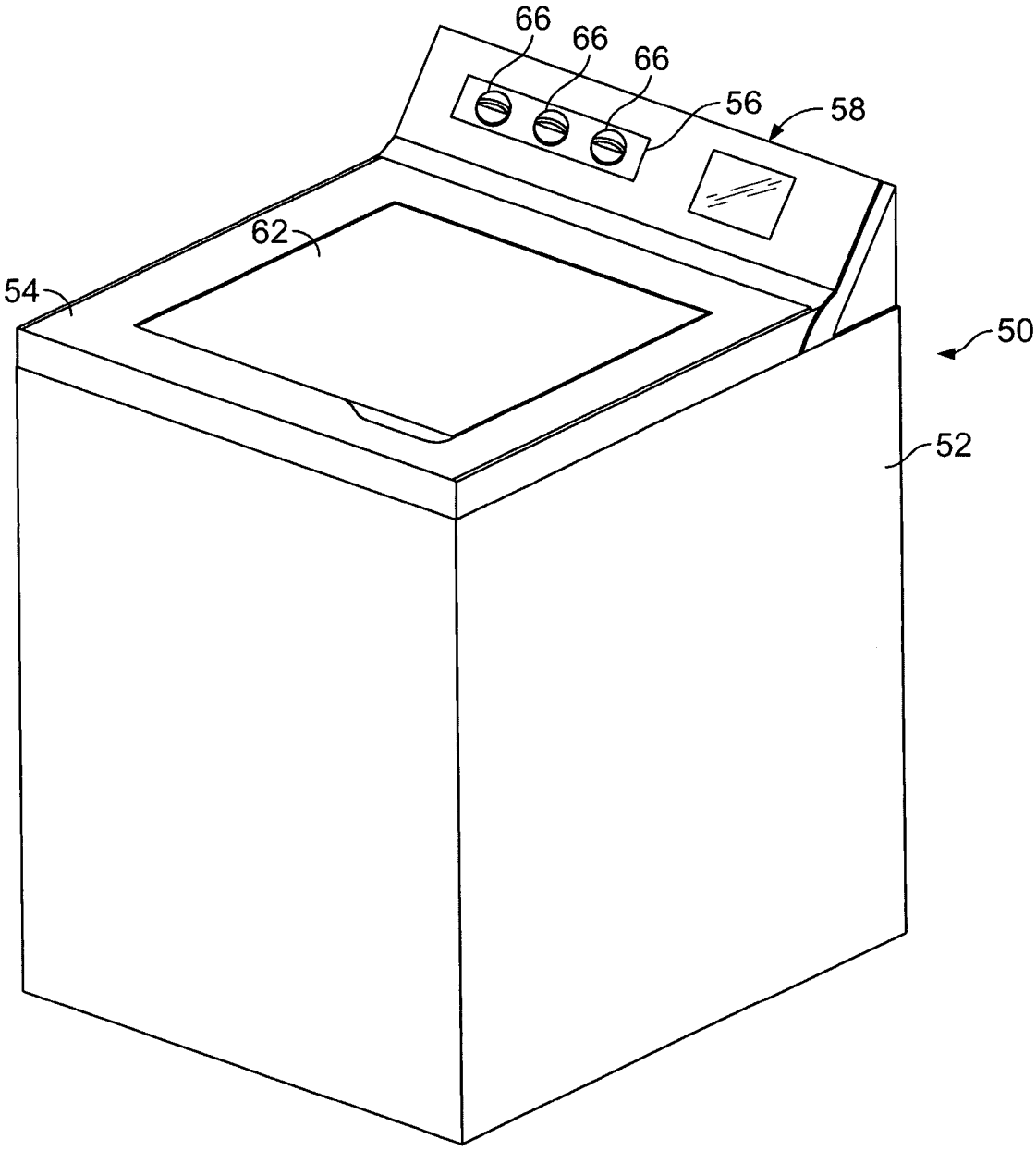
FIG. 1 is a perspective view of an exemplary washing machine including a cabinet and a cover.

FIG. 1 is a perspective view of an exemplary washing machine 50 including a cabinet 52 and a cover 54. A control panel 56 extends from cover 54, and a control panel assembly 58 is coupled to control panel 56. A lid 62 is mounted to cover 54 and is movable between an open position (not shown) facilitating access to a wash tub located within cabinet 52, and a closed position (shown in FIG. 1) forming a sealed enclosure over the wash tub. As shown in FIG. 1, machine 50 is a vertical axis washing machine. However, the washing machine exemplified in FIG. 1 and described herein is only for illustration, and is not intended to be limiting in any aspect. Although the present invention is described below in reference to its application in connection with and operation of washing machine 50, it will be apparent to those skilled in the art and guided by the teachings herein provided that the invention is likewise applicable to any suitable home appliance including, without limitation, other types of washing machines and dryers. More specifically, control panel assembly 58, as described below in detail, may be utilized in connection with any suitable household appliance and is not limited to practice in connection with any one particular home appliance.

In the exemplary embodiment, control panel 56 and a plurality of input selectors 66 collectively form a user interface input for operator selection of machine cycles and/or features.

Figure 2:
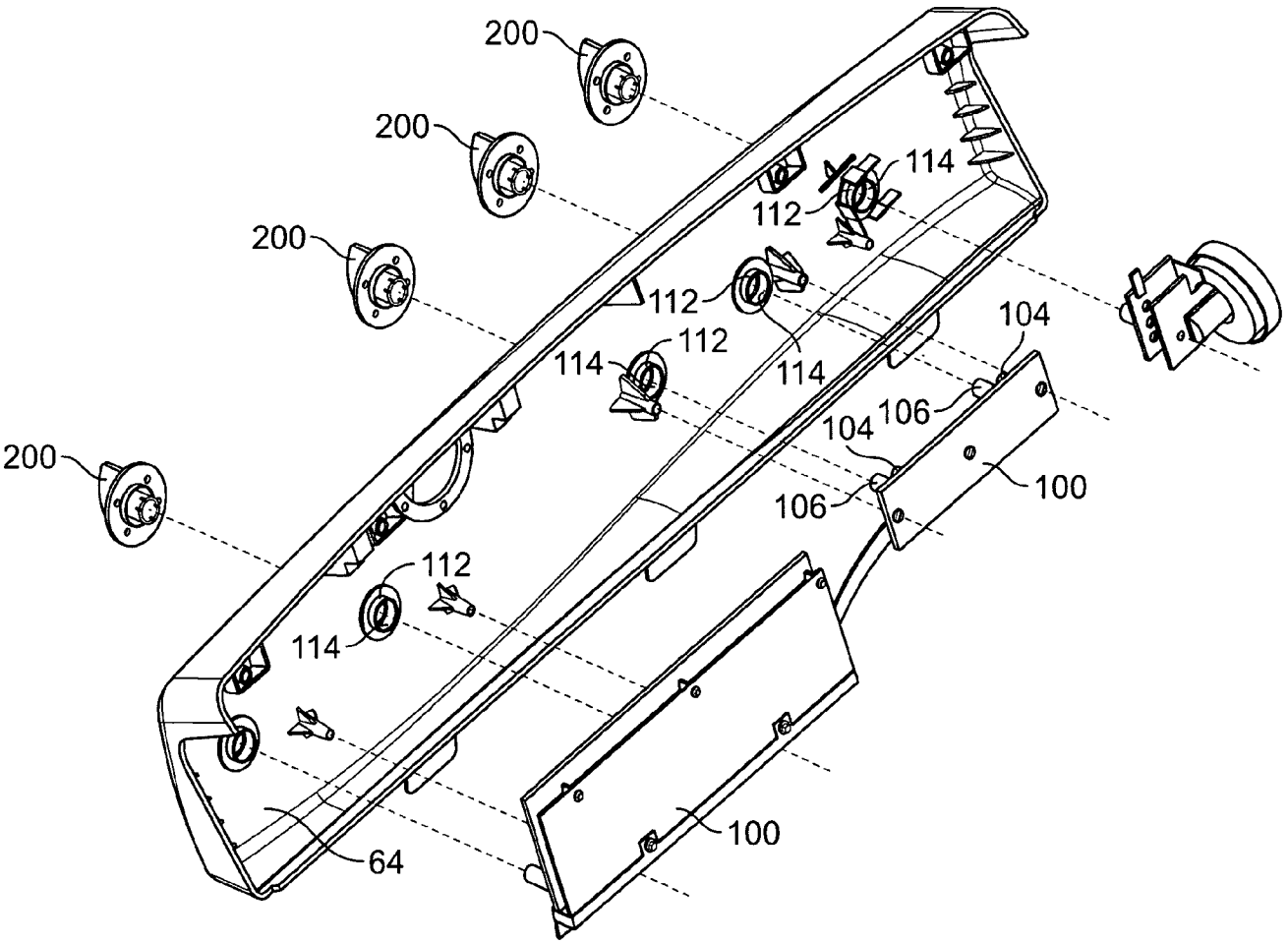
FIG. 2 is an exploded view of a control panel assembly shown in FIG. 1.

FIG. 2 is an exploded view of control panel assembly 58 shown in FIG. 1. Control panel assembly 58 is operatively coupled to a driving unit (not shown) positioned within washing machine 50 for controlling the operation of washing machine 50. The driving unit is configured to provide physical action within washing machine 50. Such driving units are well known in the art. Control panel assembly 58 includes a control board 100 including at least one functional component 102. In one embodiment, functional component 102 includes a rotary switch 104 coupled to control board 100 and a rotary shaft 106 that extends from rotary switch 104. Control panel 56 is coupled to control panel board 100. In one embodiment, control panel 56 includes at least one central cylinder 112 that defines a central opening 114. A knob 200, as described below, is positioned within central opening 114 and is coupled to control panel 56. Knob 200 is configured to shield control board 100 and/or functional components 102 from damage. In one embodiment, knob 200 is configured to limit movement of knob 200 with respect to control panel 56 and/or control board 100. Further, knob 200 is configured to provide a seal to prevent contaminants, such as liquid detergent, from undesirably contacting control panel 56, control board 100 and/or functional components 102.

Figure 3:
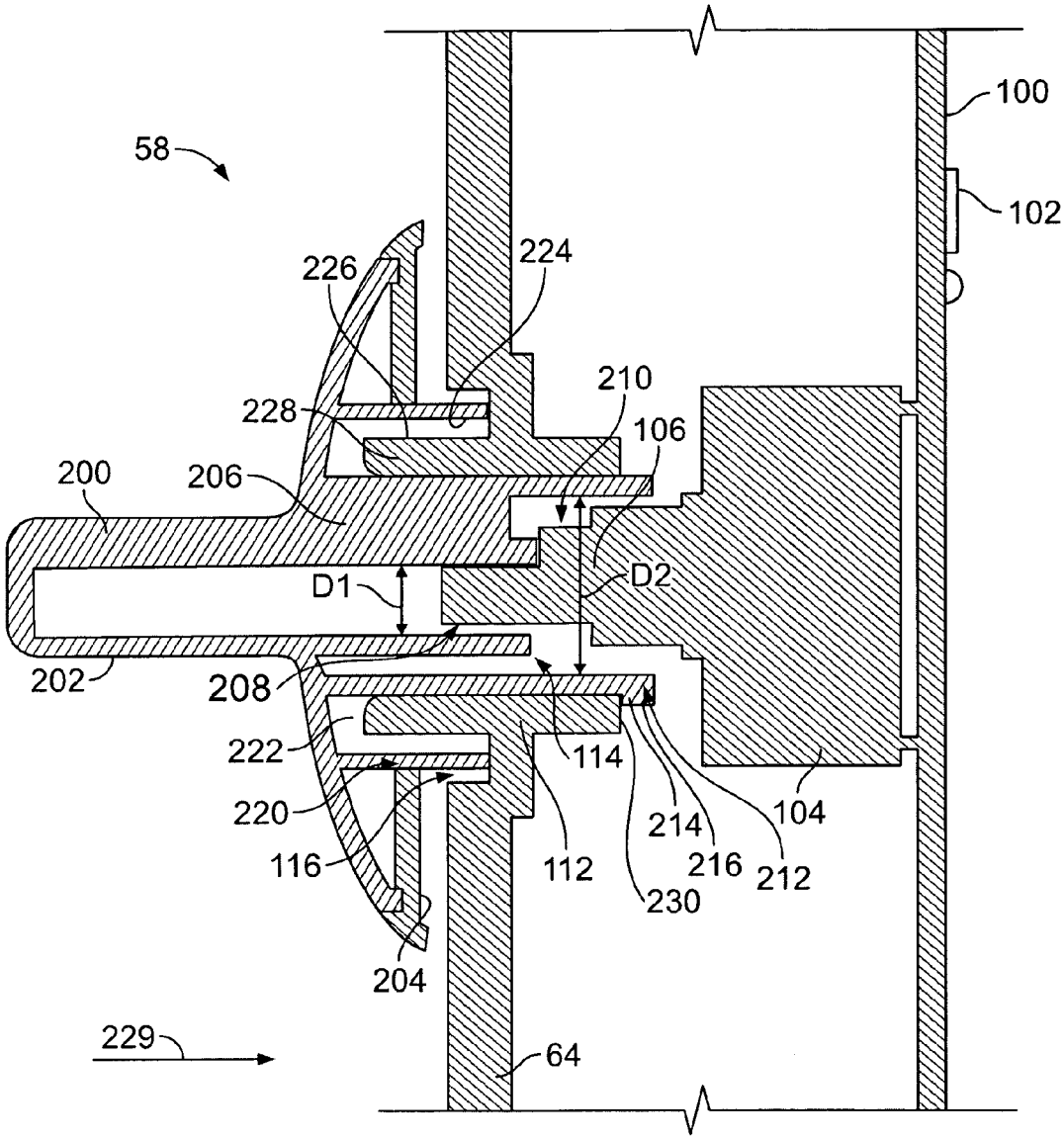
FIG. 3 is a sectional view of a control panel assembly shown in FIG. 1.

FIG. 3 is a partial sectional view of control panel assembly 58 shown in FIG. 1. In the exemplary embodiment, control panel assembly 58 includes control board 100, which includes functional components 102. Rotary switch 104 is attached to one side of control board 100 and rotary shaft 106 extends from rotary switch 104. Control panel board 100 is operatively coupled to control panel 56. Control panel 56 includes central opening 114 defined at least partially by central cylinder 112. Central opening 114 has a suitable diameter for receiving at least a portion of knob 200 and/or at least a portion of functional component 102. Control panel 56 also defines a slot 116 adjacent central opening 114 and extending at least partially about a periphery of central cylinder 112. In one embodiment, slot 116 is substantially circular in shape.

In the exemplary embodiment, control panel assembly 58 includes knob 200 designed to engage control panel 56. Knob 200 includes a front side having a surface 202 for interfacing with the appliance user, a rear side having at least one flat surface 204, and a first central cylindrical portion 206 extending from the rear side of knob 200. In one embodiment, central cylindrical portion 206 is a hollow cylinder. In a particular embodiment, a keyed receiving hole 208 and a receiving hole 210 are defined in the central portion of cylindrical portion 206 to receive rotary shaft 106. In this particular embodiment, at least a portion of rotary switch 104 is received within receiving hole 210. Keyed receiving hole 208 has a nominal diameter, D1, which is smaller than a diameter, D2, of receiving hole 210. In one embodiment, receiving hole 208 has a shape that is complementary to the shape of rotary shaft 106 and/or rotary switch 104, for example a splined shape or D-shape. At least one locking tab 212 extends from a peripheral end of central cylindrical portion 206. Each locking tab 212 includes a projection 214 with an angled surface 216 on the peripheral end. In one embodiment, a single locking tab 212 extends around the peripheral end of central cylindrical portion 216. In an alternative embodiment, a plurality of locking tabs 212 extend around the peripheral end and are separated from adjacent tabs 212 by slots (not shown).

In the exemplary embodiment, a second cylinder 220 extends from the rear side of knob 200. Second cylinder 220 has a larger diameter than that of central cylinder portion 206 and surrounds central cylindrical portion 206. A circular slot 222 is formed between an inner wall 224 of second cylinder 220 and an outside wall 226 of central cylinder portion 206. In addition, a projecting portion 228 extends from central cylinder 112 and is configured to extend within slot 222.

During assembly, control board 100 is operatively connected to control panel 56. Once control panel 56 is engaged with control board 100, and rotary switch 104 and rotary shaft 106 are received in central opening 114. Knob 200 engages control panel 56 such that keyed receiving hole 208 aligns with rotary shaft 106. Knob 200 is moved through central opening 114 in the direction indicated by arrow 229 in FIG. 3 such that at least one locking tab 212 extends into the space between the inner wall of first central cylindrical portion 206 and the outside surface of rotary shaft 106. During insertion of at least one locking tab 212 into the space, projection 214 of locking tab 212 is compressed until locking tab 214 engages an end 230 of central cylinder 112. Additionally, the wall of second cylinder 220 is received in slot 116. As such, knob 200 firmly engages control panel 56. Further, with knob 200 engaged with control panel 56, cylinder 220, slot 116, and/or central cylinder 112 form a labyrinth seal between knob 200 and control panel 56. In use, when knob 200 is rotated by a user, rotary switch 104 is also rotated via rotary shaft 106, as keyed receiving hole 208 has a shape complementary to the shape of rotary shaft 106.

The outer surface of central cylindrical portion 206 of knob 200 contacts and/or cooperates with the inner surface of central cylinder 112 of control panel 56 to transfer any transverse force exerted on knob 200 directly to control panel 56. Additionally, cylinder 220 contacts and/or interferes with a bottom surface of circular slot 116 to transfer any axial force exerted on knob 200 directly to control panel 56. As a result, control board 100 and its components are protected from possible damage under the action of outside forces. Further, due to the labyrinth seal formed between knob 200 and control panel 56, control board 100 is also protected from contamination, which may occur if liquid is spilled by the user on control panel 56. Moreover, the present invention eliminates the need for the traditional control chassis commonly found in appliances that use an electronic control.

While the invention has been described in terms of various specific embodiments, those skilled in the art will recognize that the invention can be practiced with modification within the spirit and scope of the claims.

What is claimed is:

1. A control panel assembly for controlling a home appliance, said control panel assembly comprising:

a control board including at least one functional component;

a control panel coupled to said control board, said control panel forming a central cylinder defining an opening; and a knob positioned within said opening, said knob including a front side and a rear side, a first cylindrical portion extending from said rear side and coupled to said control panel, and a second cylindrical portion extending from said rear side such that said second cylindrical portion contacts said control panel to facilitate preventing an axial force from being applied to said at least one functional component.

2. A control panel assembly in accordance with claim 1 wherein said second cylindrical portion extends into one of a slot or a surface formed on said control panel thereby forming a labyrinth seal.

3. A control panel assembly in accordance with claim 1 wherein at least one locking tab formed on said first cylindrical portion engages said central cylinder for facilitating retaining said knob within said control panel.

4. A control panel assembly in accordance with claim 1 wherein said first cylindrical portion defines a keyed receiving hole having a shape corresponding to a shape of a rotary shaft coupled to said central board.

5. A control panel assembly in accordance with claim 4 wherein said control board further comprises a switch shaft forming said rotary shaft, said rotary shaft configured to be received in said keyed receiving hole.

6. A control panel assembly in accordance with claim 4 wherein said knob further comprises a slot defined between said first cylindrical portion and said second cylindrical portion, said control panel forming a projection configured to extend into said slot.

7. A control panel assembly in accordance with claim 1 wherein said knob further comprises a surface configured for interfacing with an appliance user at said front side and at least one flat surface at said rear side thereof.

8. A control panel assembly in accordance with claim 1 wherein said second cylindrical portion contacts a surface of a slot defined about at least a portion of a periphery of said first cylindrical portion to facilitate limiting an axial movement of said knob with respect to said control board.

9. A home appliance comprising:

a housing;

a driving unit received in said housing, said driving unit configured to provide physical action within said home appliance; and a control unit assembly for controlling said driving unit, said control unit assembly comprising:

a control board including at least one functional component;

a control panel coupled to said control board, said control panel forming a central cylinder defining an opening; and a knob positioned within said opening, said knob including a front side, a rear side, a first cylindrical portion extending from said rear side and coupled to said control panel, and a second cylindrical portion extending from said rear side such that said second cylindrical portion contacts said control panel to facilitate preventinR an axial force from being applied to said at least one functional component.

10. A home appliance in accordance with claim 9 wherein said second cylindrical portion extends into one of a slot and a surface formed on said control panel thereby forming a labyrinth seal.

11. A home appliance in accordance with claim 9 wherein at least one locking tab that is formed on said first cylindrical portion engages a peripheral end of said first central cylindrical portion for facilitating retaining said knob within said opening.

12. A home appliance in accordance with claim 9 wherein said first cylindrical portion further comprises a keyed receiving hole forming a shape, said control board including a switch shaft configured to be at least partially received within said keyed receiving hole and forming a complementary shape.

13. A home appliance in accordance with claim 9 wherein said knob defines a slot between said first cylindrical portion and said second cylindrical portion, said control panel forming a projection configured to extend into said slot.

14. A home appliance in accordance with claim 9 wherein said knob comprises a surface configured for interfacing with an appliance user at said front side and at least one flat surface at said rear side thereof.

15. A method for assembling a control unit utilized in a home appliance for controlling operations thereof, said method comprising:

providing a control board with at least one functional component;

coupling a rotary shaft to the control board;

coupling a control panel to the control board, the rotary shaft extending at least partially into an opening defined in the control panel;

positioning a knob within the opening, the knob having a front side, a rear side, a first cylindrical portion extending from the rear side and a second cylindrical portion extending from the rear side; and coupling the knob to the control panel, the second cylindrical portion extendin from the rear side a length such that the second cylindrical ortion contacts the control panel to facilitate preventing an axial force from being applied to the at least one functional component.

16. A method for assembling a control unit in accordance with claim 15 wherein positioning a knob within the opening further comprises positioning the first cylindrical portion within a central cylinder defining the opening.

17. A method for assembling a control unit in accordance with claim 15 wherein the knob further comprises a circular slot defined at least partially by the first cylindrical portion and the second cylindrical portion and the control panel includes a projection formed thereon, said method further comprising inserting the projection into the circular slot.

18. A method for assembling a control unit in accordance with claim 15 further comprising engaging at least one locking tab extending from a peripheral end of the first cylindrical portion to a central cylinder defining the opening, the at least one locking tab configured to retain the knob within with the control panel.

19. A method for assembling a control unit in accordance with claim 15 wherein coupling the knob to the control panel further comprises defining a keyed receiving hole in the first cylindrical portion corresponding to a shape of at least a portion of the rotary shaft.

* * * * *